US006540493B1

(12) United States Patent
Körner

(10) Patent No.: US 6,540,493 B1
(45) Date of Patent: Apr. 1, 2003

(54) SERIES FOR GEAR PUMPS WITH DIFFERING CAPACITIES AND METHOD FOR MANUFACTURING THE INDIVIDUAL GEAR PUMP OF THE SERIES

(75) Inventor: Tillman Körner, Zang (DE)

(73) Assignee: Vohn Turbo GmbH & Company KG, Heidenheim (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/581,645

(22) PCT Filed: Oct. 18, 1999

(86) PCT No.: PCT/EP99/07878

§ 371 (c)(1),
(2), (4) Date: Aug. 15, 2000

(87) PCT Pub. No.: WO00/26539

PCT Pub. Date: May 11, 2000

(30) Foreign Application Priority Data

Oct. 29, 1998 (DE) ..... 198 49 804

(51) Int. Cl.[7] ..... F03C 2/00

(52) U.S. Cl. ..... 418/9; 418/1; 418/150; 418/196; 418/199; 418/200

(58) Field of Search ..... 418/9, 150, 200, 418/1, 199, 196

(56) References Cited

U.S. PATENT DOCUMENTS 2,691,482 A * 10/1954 Ungar ..... 418/9
2,720,171 A 10/1955 Harrington
4,943,214 A * 7/1990 Niimura et al. ..... 418/9

FOREIGN PATENT DOCUMENTS

| | | | |
|---|---|---|---|
| DE | 1403934 | 1/1969 | |
| DE | 2016171 | 10/1970 | |
| DE | 43 10 211 A1 | 3/1994 | |
| EP | 0 843 095 A1 | 5/1998 | |
| GB | 605104 | 7/1948 | |
| GB | 1297002 | * 11/1972 | ..... 418/199 |
| JP | 58-093977 A | * 6/1983 | ..... 418/9 |
| JP | 59-005892 A | * 1/1984 | ..... 418/9 |

OTHER PUBLICATIONS

Technisches Zentralblatt IV 1953, S. 347.
Gutbrod, W: Förderstrom von Aussen– und Innenzahnradpumpen In: ölhydraulik und pneumatik, 19 (1975) Nr. 2, S. 97, 101–104.

* cited by examiner

*Primary Examiner*—Thomas Denion
*Assistant Examiner*—Theresa Trieu
(74) *Attorney, Agent, or Firm*—Randall J. Knuth

(57) ABSTRACT

The invention is related to a series gear pump for differing output volumes with at least two gear pumps, each gear pump comprises at least two intermeshing displacing elements, a first displacing element and a second displacing element in the form of gears. The individual gear pumps of the series comprise a substantially identical dimensions for the axial interval between the theoretical axes and between the theoretical axes of rotation of the two displacing elements, and a substantially identical gearing width in the form of a substantially identical axial extension of the gearing elements. The individual gear pumps differ from each other at least as regards the size of the tip circle diameter of at least one of the two displacing elements.

4 Claims, 5 Drawing Sheets

Figure 1A:
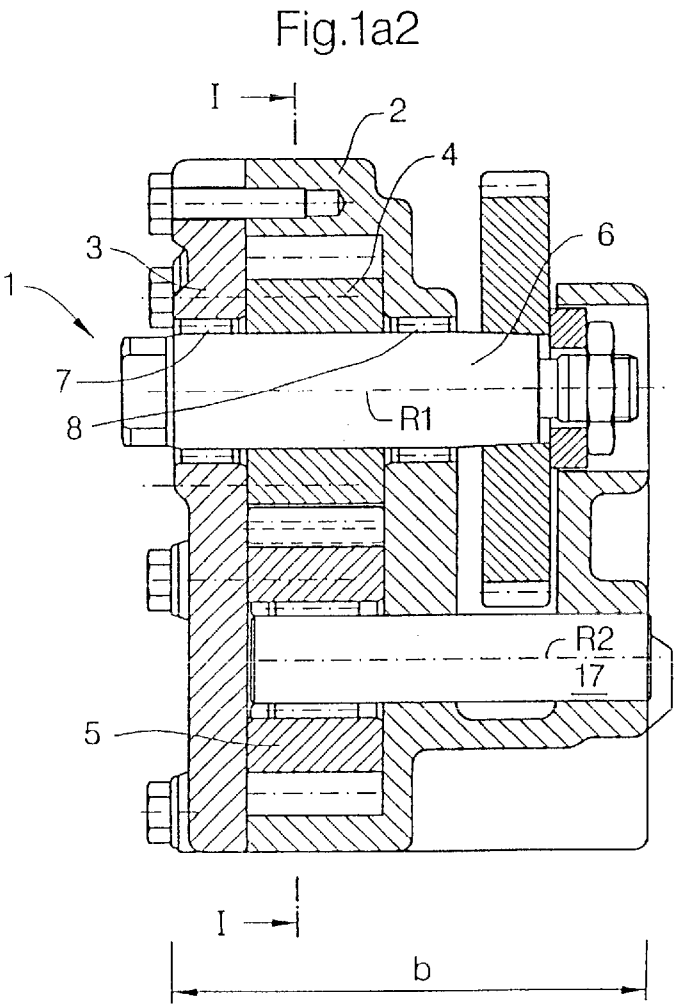

Fig.1a2
I
2
4
6
R1
R2
17
b
I
3
7
8
1
5

Figure 1A:
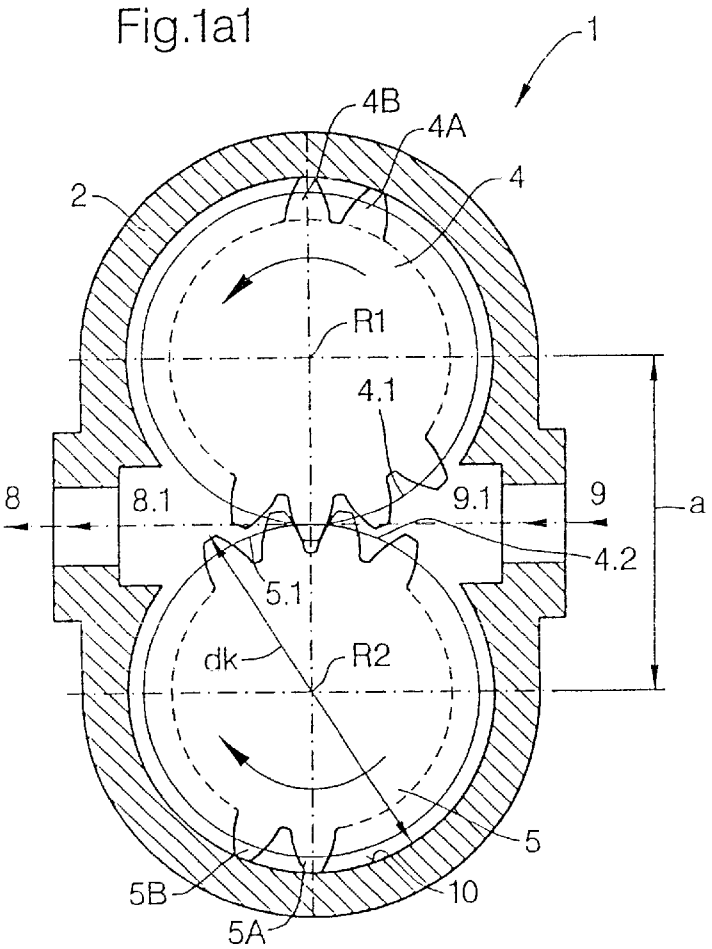

Fig.1a1
1
a
9
4.2
4
4A
4B
9.1
4.1
R1
R2
5
10
5.1
dk
5A
5B
8.1
2
8

Figure 1B:
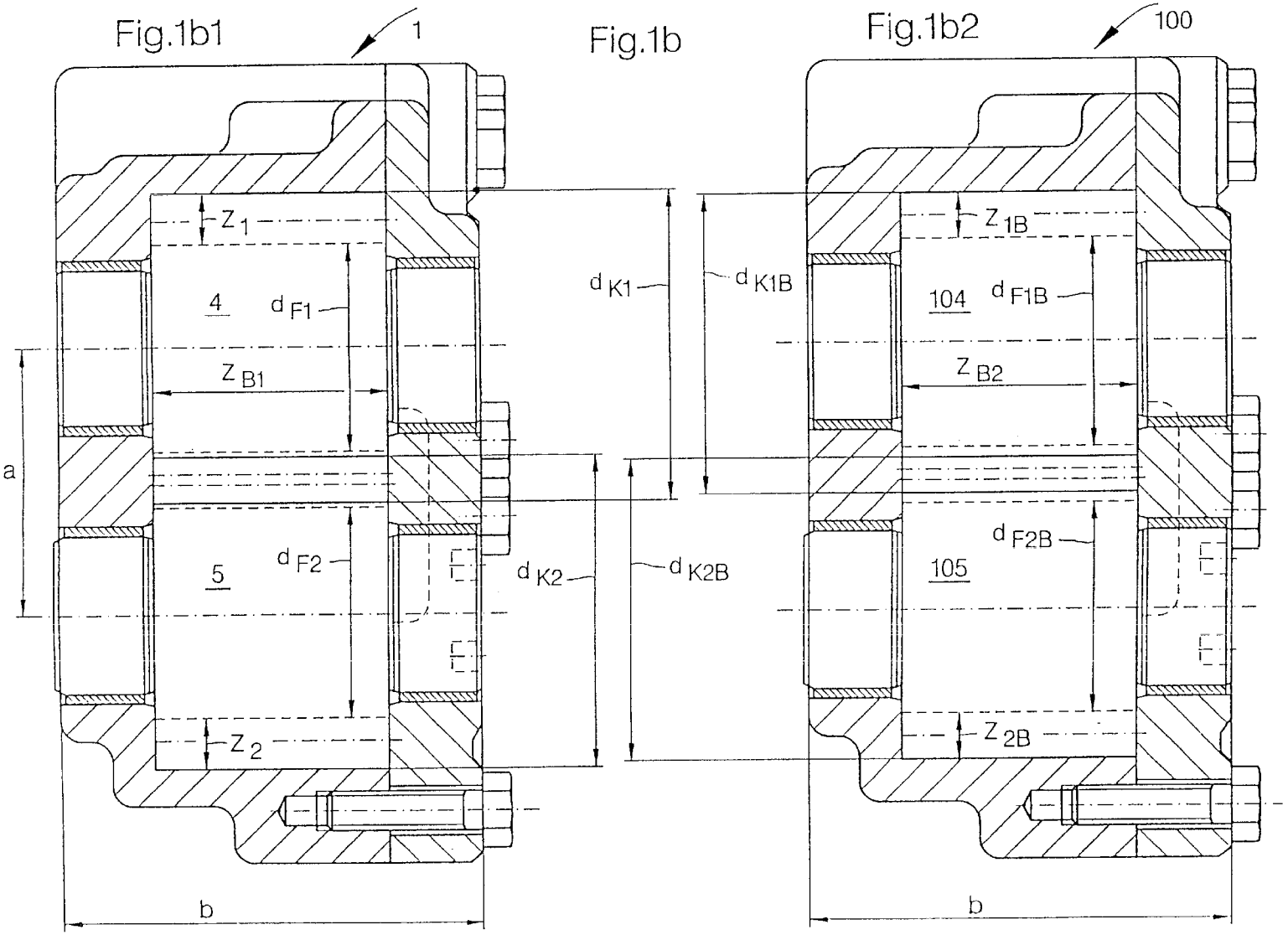

Fig.1b2
100
$z_{1B}$
$d_{F1B}$
$z_{B2}$
104
$d_{F2B}$
105
$z_{2B}$
b
$d_{K1B}$
$d_{K2B}$ $d_{K1}$
$d_{K2}$
Fig.1b1
1
$z_1$
$d_{F1}$
4
$z_{B1}$
$d_{F2}$
5
$z_2$
b
a

SERIES FOR GEAR PUMPS WITH DIFFERING CAPACITIES AND METHOD FOR MANUFACTURING THE INDIVIDUAL GEAR PUMP OF THE SERIES

The invention is relative to a series [line] for gear pumps with differing capacities and to a method of manufacturing the individual gear pumps of the series.

Hydraulic pumps in the form of gear pumps in which two gears meshing with one another, running with close tolerance in a housing and used as displacing elements are known in a plurality of designs. As regards the type of displacing elements, two types are distinguished:

a) Gear pumps with external gearing [toothing], b) Gear pumps with internal gearing.

See in this connection Dubbel: Taschenbuch für den Maschinenbau [German-Pocketbook for Machine Construction], $18^{th}$ edition, H4 to H5. Pumps with internal gearing are known, e.g., from Voith publication G 1210 8.80 1000. The main characteristics of a hydraulic pump are the geometric displacement volume and the nominal pressure. Due to the very varied areas of application and the requirements of use resulting therefrom, hydraulic pumps for differing output [delivery] volumes are offered. The work takes place as a rule in series in that the individual pumps of a series have the same construction but differ significantly from each other in their characteristics. An enlargement of the construction size is associated with a corresponding increase in the output volume. This can be gathered, e.g., from Voith publication 3.83, pp. 4 to 5 in the example of a pump with internal gearing. The enlargement of the possible output flow takes place at rather large intervals in groups. The essential distinguishing feature between the groups resides in either the differing radial or axial dimension of the displacing elements. Within the groups an elevation of the possible output volume takes place in smaller steps by enlarging the gearing width, that is, the extension of the gearing in axial direction. This has the result that the individual pumps in drive [train] lines are not freely exchangeable as a rule if the requirements of use are changed since the latter differ sharply as regards the required construction space and similarities between the individual types can hardly be determined.

The invention therefore has the basic problem of creating a series for gear pumps for differing output volumes that are therefore suitable for different requirements of use in which series the individual pumps have as many constructive features in common as possible and differ solely by slight inner modifications. The pumps themselves are to be kept as small as possible as regards the required construction space and there should be the possibility of replacement with a pump with a greater or lesser output volume in hydrostatic systems without the entire drive chain having to be replaced.

The solution of the invention is characterized by the features of claim 1. Advantageous embodiments are described in the subclaims.

A series of gear pumps for differing output volumes comprises at least two pumps. Each pump comprises at least two gears meshing with one another as displacer or displacing elements. The invention provides that each pump in the series has the following construction features that are essentially identical as regards the dimension:

a) Axial [shaft—German "Achse"=axis, axle and shaft] interval between the axes [shafts] of the two gears meshing with one another, b) Gearing width, that is, extension of the gearing in axial direction.

That is, the pumps of the series all have the same axial interval and the same gearing width.

However, the indication "essentially identical" should include customary finishing tolerances.

The differing output volumes are adjusted in accordance with the invention in pumps of a series with the same axial interval between the individual displacing elements and a constant gearing width over the cog height. It is sufficient thereby if at least one of the two gears meshing with one another is changed as regards its tip [addendum] circle diameter; however, it is preferable if both gears are changed as regards their tip circle diameter.

The inventor realized that relatively high output volumes can be achieved when using so-called high gearings since the sensitivity oft he output volume over the tip circle diameter or the tip circle radius is significantly higher than in the case of normal gearings. Even slight changes in the tip circle are sufficient to achieve a corresponding increase of the output volume. The volumetric increase in radial direction of the individual pump relative to the axes of the displacing elements or of the axes of symmetry of the displacing elements is relatively slight. This statement also applies in an analogous manner to a diminution of the tip circle diameter or tip circle radius of an individual displacing element. The axial construction length remains constant for all gear pumps of the series. A change takes place only in radial direction during which only a lesser increase in volume for the entire gear pump construction unit is realized on account of the high sensitivity of output volume over the tip circle radius. The uniform axial construction length of the gear pump construction unit makes it possible to replace the gear pump arranged in a drive chain in accordance with the requirements of use on the volume to be delivered with another gear pump of this series that is designed for greater or lesser output volumes without the entire drive chain having to be replaced or readapted to the hydraulic pump to be used.

In an especially preferred embodiment of the gear pump series a constant transverse pitch p is assigned to the particular displacing elements, that is, gears of the individual pumps in the series, in the case of an axial interval that can be predefined and is constant for all pumps in the series, that is, the modulus as dimensional factor of the gearing is also constant for all pumps so that there is the possibility of developing the displacing elements for the individual gear pumps with differing output volumes from a pump arrangement with a unified basic displacing element as described, e.g., in claim 8, in which the basic gearing is designed for a maximum output volume of at least one of the two displacing elements as a high gearing and for a minimum output volume the gearing or the individual cog [tooth] elements are reduced in size [by removing metal] or milled down correspondingly to a smaller tip circle diameter. This procedure makes it possible to create a series for gear pumps with different output volumes in which the individual gear pumps are designed to be especially compact and very standardized as regards the individual elements. The high degree of standardization results in a diminution of the manufacturing cost, which for its part is reflected in the [total] cost.

The design of the basic construction unit for the maximum output volume as regards the individual gears meshing with each other takes place in accordance with the fundamentals of the geometry of gear pairs. This applies to the general instance that influence is exerted only on the cog height, regardless of the form, and to the especially advantageous embodiment in which, starting from a displacing element designed for maximum output volume, lesser output volumes can be realized by shortening the cog height, that is, removing material.

The solution of the invention can be used in gear pumps with a) external gearing, b) internal gearing.

It is immaterial thereby whether the gear pumps are single-flow or multiflow gear pumps.

In gear pumps with externally cogged displacing elements both displacing elements are preferably designed and constructed to be similar in their size and gearing geometry whereas in the case of dual-flow or multiflow gear pumps displacing elements with differing designs and dimensions are used.

FIG. 1*a* shows a section through a gear pump of the series designed in accordance with the invention for gear pumps and a view I—I.

FIGS. 1*b*1 and 1*b*2 show opposing views of two possible designs for pumps in axial section of a pump series designed in accordance with the invention using a single-flow gear pump with external gearing. FIG. 1*b*1 shows a pump with a rather large output volume of a series and FIG. 1*b*2 shows a pump with a rather small output volume.

Figure 2A:
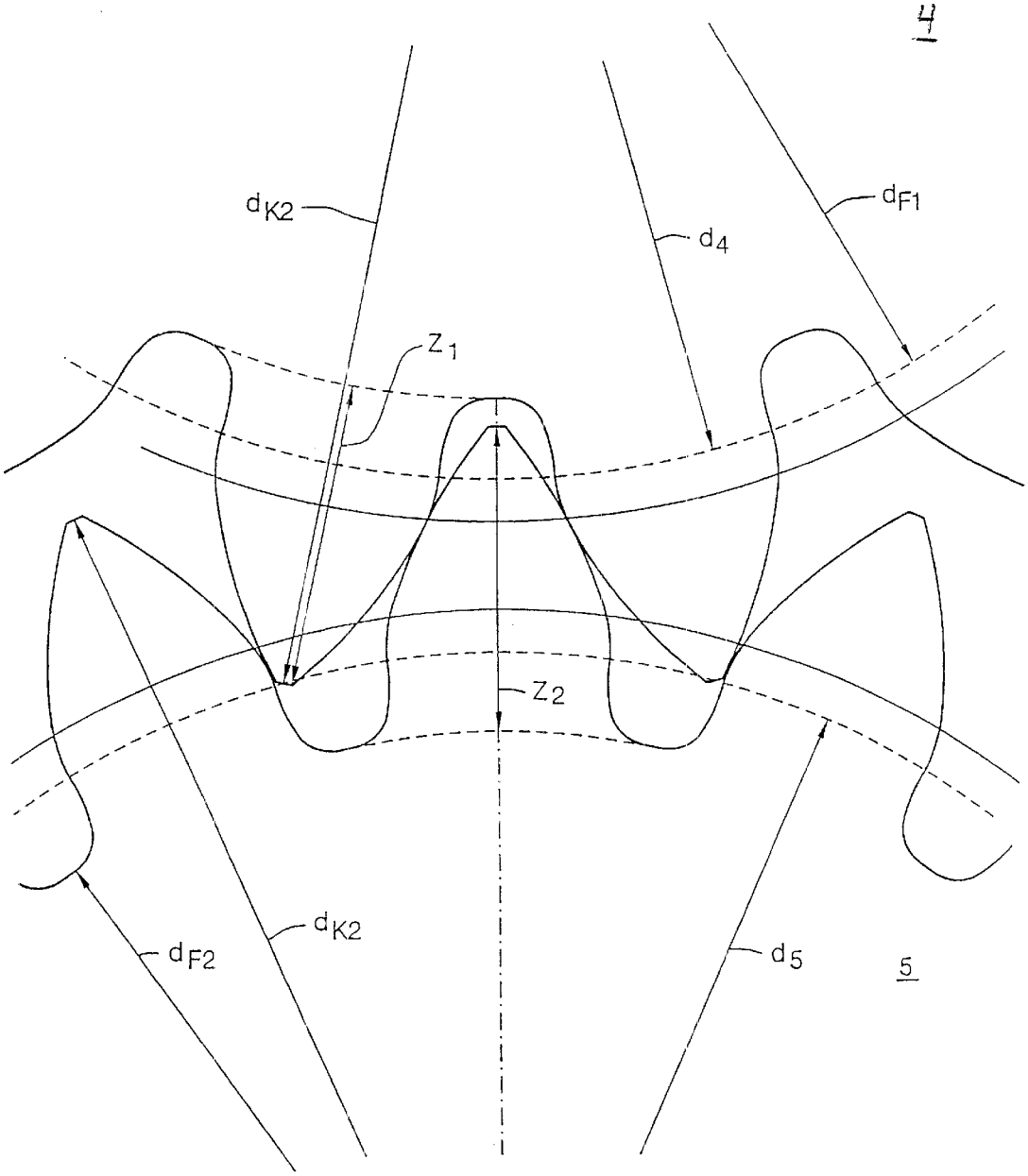
Figure 2B:
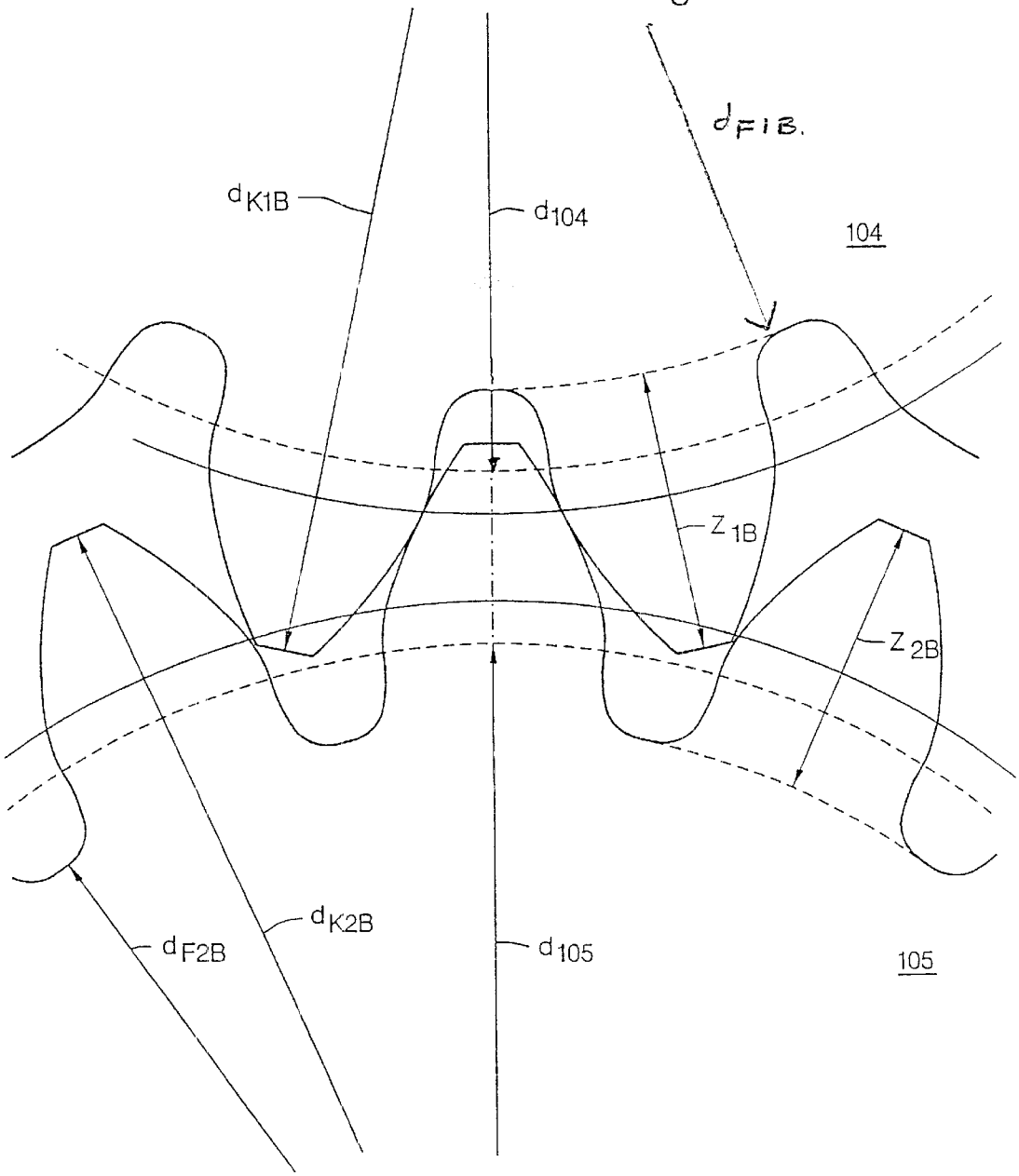

FIGS. 2*a* and 2*b* each show a section of the intermeshing gearing of the displacing elements of the pumps shown in FIGS. 1*a* and 1*b*.

Figure 3:
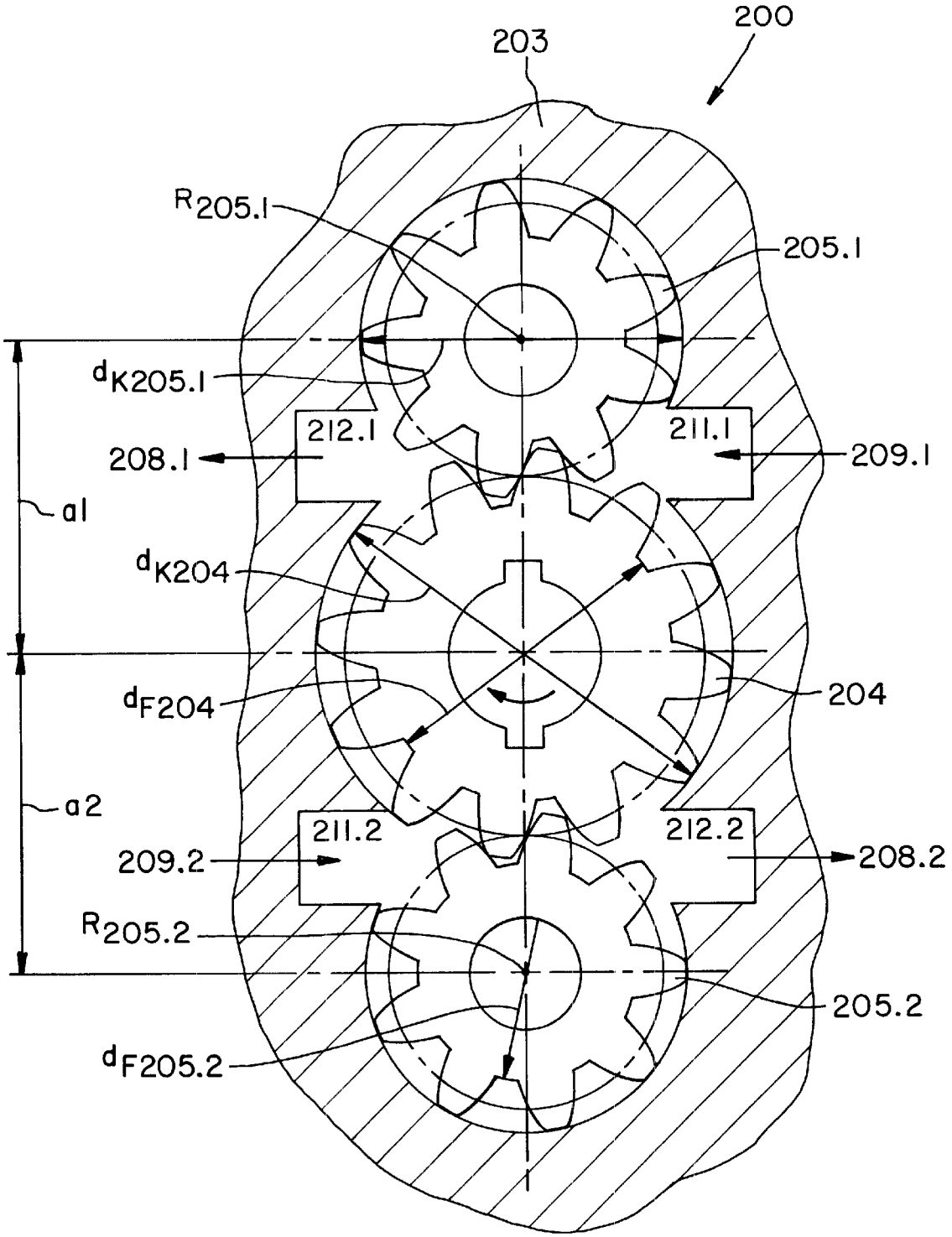

FIG. 3 shows an application of the solution of the invention for multiflow gear pumps with external gearing.

FIG. 1*a*1 shows a section through a gear pump 1 of the series for gear pumps for differing output volumes which series is designed in accordance with the invention. This pump comprises housing 2 limited on its front by cover 3. The two displacing elements, a first displacing element 4 and a second displacing element 5, are arranged in the housing. Displacing elements 4 and 5 are designed as externally cogged gears in the form of spur gears meshing with each other. Both run with a close tolerance in housing 2. The first displacing element 4 is mounted on drive shaft 6. Drive shaft 6 is mounted for its part of via bearing 7,8 in housing 2 and cover 3 terminating the housing. Moreover, gear pump 1 comprises pressure connection 8 and suction connection 9. Both suction connection 9 and pressure connection 8 are coupled to corresponding spaces, a so-called pressure chamber 8.1 and a suction chamber 9.1. The rotary motion introduced via drive shaft 6 with first displacing element 4 moves pinion shaft 17 of second displacing element 5 with the latter in the opposite direction. A vacuum is then produced in suction chamber 9 which causes hydraulic fluid to be drawn in from the suction line that can be coupled to a container not shown in detail here. The hydraulic fluid is transported to pressure chamber 8 in the cog spaces of the displacing elements, cog spaces 4.1 of the first displacing element and cog spaces 4.2 of the second displacing element and from there it is supplied to an appropriate consumer or displaced in that direction. There is the additional possibility of designing gear pump 1 with axial play [tolerance] compensation. This can take place via a one-sided loading of the bearing of the displacing elements or via loading both sides with operating pressure. This has the advantage that the axial play of the individual gears can be reduced in a pressure-dependent manner. Since the greatest volumetric losses occur from leaking oil exiting on the front sides from the pressure chamber to the suction chamber, a very good volumetric efficiency can be achieved by adjusting the axial play.

The output volume is described in accordance with the invention by the individual gearings of displacing elements 4,5 and by inner wall 10 of housing 2, that is, by the so-called cog spaces 4.1,5.1 between two adjacent cog elements 4A, 4B and 5A, 5B of individual displacing elements 4,5 as shown in a non-dimensionally correct manner in FIG. 1*a*1 in view I—I corresponding to FIG. 1*a*2.

Both displacing elements 4,5 are designed identically for the embodiment according to FIG. 1*a*1, that is, they have the same geometric dimensions. Axes R1 of rotation and symmetry for displacing element 4 and R2 for displacing element 5 have a certain interval, that is, the axial interval a in the instance shown. The extension of the construction unit gear pump 1 in axial direction is characterized by dimension b.

It is apparent from FIGS. 1*b*1, 1*b*2 for an embodiment of a gear pump 1 and a further gear pump 100 from the gear pump series of the invention that the interval of the theoretical axes of rotation and axes of symmetry R1, R2, which is also designated as axial interval a, and the axial extension b are identical for both pumps. Axial interval a, which is determined as a rule by the interval of the axes on which the individual displacing elements are mounted, can also be understood as the interval between two rotating shafts, as is the case when the second displacing element is connected to a shaft in such a manner that it is adapted to rotate in unison [with said shaft]. At least the first displacing element is connected to the drive shaft in such a manner that it rotates in unison with it.

The significant difference between the two gear pumps 1 and 100 of the gear pump series is that the displacing elements have different tip circle diameters.

FIG. 1*b*2 shows in this regard a design with reduced output volumes in comparison to gear pump 1 in accordance with FIG. 1*b*1. To this end [in addition,] displacing elements 4,5 for gear pump 1 and 104, 105 for gear pump 100 are designed as a high gearing. The tip circle diameter $d_{K1B}$, $d_{K2B}$ for displacing elements 104 and 105 is less than tip circle diameter $d_{K1}$, $d_{K2}$ of gearing elements 4A, 4B of gear pump 1. Root circle diameters [root diameters] $dF_{1B}$ and $dF_{2B}$ for the individual displacing elements 104, 105 and $dF_1$ and $dF_2$ of displacing elements 4,5 of gear pumps 100 and 1 are identically designed. Due to the difference in form of cog height $z_{1A}$, $z_{1B}$ and $z_2$ resulting therefrom, different sizes therefore result for the possible displaceable volume between two adjacent cog elements 104A, 104B respectively 4A respectively 4B and 105A, 105B respectively 5A, 5B at the same axial extension and therewith gearing width $Z_{B1}$ and $Z_{B2}$.

The design shown with two identically designed displacing elements 4,5 respectively 104 and 105 represents an especially preferred design. This design makes it possible, starting with a gear pump design with displacing elements 4,5 in accordance with FIG. 1*b*1, to develop displacing elements 104, 105 of gear pump 100 by means of a simple working of the displacing elements. This can take place, as already explained, by simply milling down the individual gearing elements and reducing therewith the cog height.

The gearing shown is a straight-cog gearing or radially serrated gearing [spur gearing]. These gearings are preferably designed as an involute gearing. However, it is also conceivable that the gearing of the individual gearing elements can be designed in a manner complementary to each other as a spiral [helical] gearing. Such a design is distinguished by a very low development of noise at large and small output volumes. The face contact ratio and transverse contact ratio obtained is then still more than 2 in both instances.

FIGS. 2*a* and 2*b* illustrate sections on the right in FIGS. 1*b*1 and 1*b*2 on an enlarged scale. The latter serve to illustrate the intermeshing of the individual gearing elements of the individual displacing elements 4,5 and 104, 105. FIG. 2*a* shows an embodiment in accordance with FIG. 1*b*1 and FIG. 2*b* shows an embodiment in accordance with FIG. 1*b*2. For the sake of clarification the geometric magnitudes for the characterization of a gearing are described. Base circle diameters $d_4$, $d_{104}$, $d_5$, $d_{105}$ are shown as well as, in addition, tip circle diameters $dK_2$, $d_{K1b}$ and root circle diameters $d_{F1}$, $d_{F2}$, $d_{F2B}$, $d_{F1B}$ and cog heights $z_1$, $z_2$, $z_{1B}$ and $z_{2B}$. By way of example, the individual displacing elements 4,5 and 104, 105 exhibit an identical pitch p for both embodiments in accordance with FIGS. 2*a* and 1B.

The design of the displacing elements of a pump of a pump series with identical dimensions and with identical geometric design makes possible an especially standardized manufacture of the individual pumps of the pump series.

FIG. 3 shows a view from the right in a sectional representation of gear pump 200 with external gearing in the form of a dual-flow gear pump. This pump comprises three displacing elements, a first displacing element 204 and two other displacing elements 205.1 and 205.2. The latter are located and mounted in housing 203 with a preferably axially designed housing cover. Gear pump 200 comprises two suction connections 209.1 and 209.2 as well as two pressure connections 208.1 and 208.2. These connections are connected respectively to corresponding suction chambers 211.1, 211.2 and to pressure chambers 212.1 and 212.2. The suction chambers and pressure chambers are formed in the area of the intermeshing displacing elements. Displacing element 204 functions as a drive element and is therefore connected at least indirectly to the drive shaft or another device in such a manner that it rotates in unison therewith and displaced element 204 is mounted on an axle by a sleeve bearing. The torque is transmitted via displacing element 204 onto the two other displacing elements 205.1 and 205.2 that then rotate about their theoretical axes of rotation $R_{205.1}$ and $R_{205.2}$. To this end the two displacing elements 205.1 and 205.2 are either mounted on a shaft in such a manner that they rotate in unison with it or on an axle. In the instance shown the displacing elements are designed with different dimensions. In particular, they differ as regards their tip circle diameter $d_K$, the root circle diameter $d_F$ and the base circle diameter d. The tip circle diameter of both 205.1 and 204 are shown in FIG. 3 as $d_{K205.1}$ and $d_{K204}$ respectively. Also, the root circle diameter of 204 and 205.2 are shown in FIG. 3 as $d_{F204}$ and $d_{K205.2}$ respectively. The two second displacing elements 205.1 and 205.2 are preferably identically designed as regards their geometric dimensions in the axial and radial direction, as shown in FIG. 3. However, designs are also conceivable that have different second displacing elements 205.1 and 205.2. However, the form shown in FIG. 3 is preferably selected since it allows a very high degree of standardization. The direction of transport of the operating material is indicated by arrows. It is apparent therefrom that two different directions of flow and therewith transport directions are made possible with this gear pump 200.

In a gear pump series of gear pumps with external gearing according to FIG. 3, which series is in accordance with the invention, axial intervals a1 and a2 between the individual gear pumps of the pump series are maintained constant and only the gearing height is changed in a manner analogous to that described in FIGS. 1 and 2. The individual gear pumps of the gear pump series designed in accordance with the invention can thus likewise be developed in a simple manner from a gear pump in accordance with FIG. 3 with a basic configuration for displacing elements 204 respectively 205.1 and 205.2. The individual gearings are also designed as high gearings in this instance too, which has the advantage of achieving the widest possible scatter [spread] of the theoretical output volumes while constantly assuring the operation of the gear pump, in particular the seal between the suction chamber and the pressure chamber.

The embodiments shown in FIGS. 1 to 3 constitute preferred embodiments of gear pumps of a gear pump series in accordance with the invention. However, modifications that make use of the solution of the invention are also conceivable. The concrete design as a function of the requirements of use is left to the determination of an expert in the art.

What is claimed is:

1. A series of gear pumps for differing output volumes, comprising:

a series of at least two individual gear pumps;

each of said individual gear pumps having a housing with at least two intermeshing displacing elements with a first displacing element and a second displacing element in the form of gears located therein;

each of said individual gear pumps of said series having substantially identical dimensions for the axial interval between the theoretical axes of rotation of said at least two intermeshing two displacing elements and a substantially identical gearing width in the form of a substantially identical axial extension of the gearing elements; and each of said individual gear pumps differing from each other at least as regards the size of the tip circle diameter of at least one of said two intermeshing displacing elements.

2. The series of gear pumps for differing output volumes according to claim 1, characterized in that said individual displacing elements of the individual gear pump or of the gear pumps of the series are designed in such a manner geometrically that the gearing can be described by a constant transverse pitch p.

3. The series of gear pumps with differing output volumes according to claim 1, characterized in that the displacing elements are designed as gears with external gearing.

4. A method of manufacturing gear pumps of a pump series comprising forming a series of basic gear pump units with a certain axial interval between the geometric axes or the theoretical axes of rotation of at least two displacing elements with a certain defined axial extension and with a certain tip circle diameter of the individual displacing elements, each of said basic gear pump units having a housing wherein said at least two displacing elements are located therein, said basic gear pump units differing from each other at lease as regards the size of the tip circle diameter of at least one of said at least two displacing elements and forming a gear pump with a lesser output volume by reducing the gearing height by removing material from the basic gear pump unit.

* * * * *